US010531698B2

(12) United States Patent
Stolker

(10) Patent No.: US 10,531,698 B2
(45) Date of Patent: Jan. 14, 2020

(54) SOFT ATHLETIC HELMET AND REAR CLOSURE MECHANISM

(71) Applicant: Hummingbird Sports, LLC, Holmdel, NJ (US)

(72) Inventor: Robert H. Stolker, Holmdel, NJ (US)

(73) Assignee: Hummingbird Sports, LLC, Holmdel, NJ (US)

( * ) Notice: Subject to any disclaimer, the term of this patent is extended or adjusted under 35 U.S.C. 154(b) by 53 days.

(21) Appl. No.: 15/589,351

(22) Filed: May 8, 2017

(65) Prior Publication Data

US 2017/0318890 A1 Nov. 9, 2017

Related U.S. Application Data

(60) Provisional application No. 62/332,913, filed on May 6, 2016.

(51) Int. Cl.

| | |
|---|---|
| ***A42B 3/08*** | (2006.01) |
| ***A42B 3/06*** | (2006.01) |
| ***A42B 1/22*** | (2006.01) |

(52) U.S. Cl.

CPC ..... *A42B 3/085* (2013.01); *A42B 3/069* (2013.01); *A42B 1/225* (2013.01)

(58) Field of Classification Search

CPC ..... A42B 1/225; A42B 3/085; A42B 3/069; A42B 3/125

USPC ..... 2/421, 425, 414, 171.4, 171.5

See application file for complete search history.

(56) References Cited

U.S. PATENT DOCUMENTS

| | | | |
|---|---|---|---|
| 2,140,716 | A | 12/1938 | Pryale |
| 2,908,943 | A | 10/1959 | Miller |
| 3,818,508 | A | 6/1974 | Lammers et al. |
| 3,866,243 | A | 2/1975 | Morgan |
| 3,870,841 | A | 3/1975 | Makowski et al. |
| 4,477,929 | A | 10/1984 | Mattsson |
| 4,621,940 | A | 11/1986 | Anderson |
| D287,501 | S | 12/1986 | Davis |
| 4,754,501 | A | 7/1988 | Yahn |
| 4,808,469 | A | 2/1989 | Hiles |
| 4,845,786 | A | 7/1989 | Chiarella |
| 4,853,980 | A | 8/1989 | Zarotti |
| 4,946,726 | A | 8/1990 | Sandvig et al. |
| 5,010,598 | A | 4/1991 | Flynn et al. |
| 5,056,162 | A | 10/1991 | Tirums |
| 5,088,130 | A | 2/1992 | Chiarella |
| 5,150,479 | A | 9/1992 | Oleson |
| 5,177,815 | A | 1/1993 | Andujar |

(Continued)

FOREIGN PATENT DOCUMENTS

| | | | |
|---|---|---|---|
| DE | 2746897 | A1 | 4/1979 |
| FR | 2294659 | A1 | 7/1976 |
| WO | WO/2011/149895 | A1 | 12/2011 |

OTHER PUBLICATIONS http://www.gamebreaker.com/.
http://www.rehabmart.com/category/Protective_Helmets.hmt.

*Primary Examiner* — Katherine M Moran
(74) *Attorney, Agent, or Firm* — Vos-IP, LLC

(57) ABSTRACT

A protective headgear having a protective outer layer, an inner impact dispersing layer, an opening in the posterior of the helmet to allow hair to exit the protective helmet, and juxtaposed to the posterior opening, a flap that covers a portion of the opening and is selectively attachable to the inner impact attenuating layer.

7 Claims, 9 Drawing Sheets

(56) References Cited

U.S. PATENT DOCUMENTS 5,272,773 A 1/1993 Kamata
5,309,576 A 5/1994 Broersma
5,361,420 A 11/1994 Dobbs et al.
5,412,810 A 5/1995 Taniuchi
5,477,563 A 12/1995 Gentes et al.
5,517,698 A 5/1996 Nault et al.
5,535,454 A * 7/1996 Ryan ..... A42B 1/225 2/209.7
5,598,588 A 2/1997 Lee
5,603,117 A 2/1997 Hudner, Jr. et al.
5,655,227 A 8/1997 Sundberg et al.
5,713,082 A 2/1998 Bassette et al.
5,790,988 A * 8/1998 Guadagnino, Jr. ..... A42B 3/00 2/411
5,930,841 A 8/1999 Lampe et al.
5,950,244 A 9/1999 Fournier et al.
D424,246 S 5/2000 Ho
6,065,159 A * 5/2000 Hirsh ..... A42B 1/08 2/413
6,070,271 A 6/2000 Williams
6,108,825 A 8/2000 Bell et al.
6,330,849 B1 12/2001 Chao
6,389,607 B1 5/2002 Wood
6,453,477 B1 9/2002 Bainbridge et al.
D464,174 S 10/2002 Lu
6,715,153 B2 4/2004 Mitsuhashi
6,986,168 B2 1/2006 Abelman
7,058,989 B2 6/2006 Domingos
7,103,923 B2 9/2006 Picotte
7,152,253 B2 12/2006 Abelman et al.
D535,059 S 1/2007 Lam
D577,458 S 9/2008 Chan
7,765,622 B2 8/2010 Wiles
7,832,023 B2 11/2010 Crisco
8,191,179 B2 6/2012 Durocher et al.
8,256,032 B2 9/2012 Muskovitz
D669,225 S 10/2012 Woxing
8,296,868 B2 10/2012 Belanger et al.
D671,272 S 11/2012 Clement
D683,904 S 6/2013 Ho
D683,905 S 6/2013 Wills
8,484,762 B2 7/2013 Goldstein
8,613,114 B1 12/2013 Olivares Velasco
8,640,267 B1 2/2014 Cohen
D700,746 S 3/2014 Capozzi
8,763,166 B1 7/2014 Olivares Velasco
8,832,870 B2 9/2014 Belanger et al.
8,997,265 B2 4/2015 Olivares Velasco
D745,744 S 12/2015 Saam
D752,294 S 3/2016 Chilson
D752,814 S 3/2016 Chilson
D759,899 S 6/2016 Finiel
D773,120 S 11/2016 Storey
D776,357 S 1/2017 Marting
2004/0154080 A1 8/2004 Abelman et al.
2004/0209744 A1 10/2004 Tsujimoto
2004/0250340 A1 12/2004 Piper et al.
2005/0204456 A1 9/2005 Piper et al.
2006/0000009 A1* 1/2006 Fleming ..... A42B 3/00 2/412
2006/0206976 A1 9/2006 Futch
2011/0225706 A1 9/2011 Pye
2012/0047636 A1* 3/2012 Fehmel ..... A42B 1/225 2/421
2012/0233746 A1 9/2012 Jwa
2012/0317705 A1 12/2012 Lindsay
2013/0025031 A1 1/2013 Laperriere et al.
2013/0036531 A1 2/2013 Belanger et al.
2013/0174329 A1 7/2013 Hanson et al.
2014/0096312 A1 4/2014 Vito
2015/0320134 A1* 11/2015 Stolker ..... A63B 71/10 2/411

* cited by examiner

SOFT ATHLETIC HELMET AND REAR CLOSURE MECHANISM

CROSS REFERENCE TO RELATED APPLICATION

This application claims the benefit of U.S. Provisional Application Ser. No. 62/332,913, filed May 6, 2016, the disclosure content of which is hereby incorporated by reference in its entirety.

FIELD OF INVENTION

The present application is generally related to soft athletic helmets and closure mechanisms for the same, specifically, closure mechanisms at the rear portion of the helmet for securing the hair of the user.

BACKGROUND OF THE INVENTION

Athletic competition continues to evolve where athletes are faster and stronger, and thus athletes face greater risk of injury due to their own strength, the strength of their competition, and the ability to throw a ball with greater force than ever before. This evolution is present for both men and women, yet the protection provided to female athletes is not commensurate in protection to those afforded to male counterparts.

Women's athletics continue to evolve at a rapid pace from mostly non-contact sports to sports that show few, if any, differences from the male version of the game. This is especially evident in several field sports, including lacrosse and field hockey, where today, women's lacrosse and women's field hockey continue to evolve to include additional physical contact, whether explicitly allowed by the rules, or simply by virtue of evolution of the game and the speed and skill of those playing.

However, both women's lacrosse and women's field hockey have typically eschewed the use of face protection or helmets because of the fact that the sports, by rule, do not allow physical contact on the field. However, the current state of the game reveals that today, athletes, coaches, and parents of young athletes understand that physical contact is inevitable and that young athletes, in particular, are highly susceptible to head injuries while playing in organized sports. Specifically, there is an increased awareness of the danger and frequency of concussion in organized sport. Furthermore, modern research and studies have identified that repeated concussions may have a significant and long term effect on athletes, including the development of chronic traumatic encephalopathy, which is a degenerative disease highly correlated to those individuals who have suffered from repeated head injuries.

While women's lacrosse and field hockey have been slow to adapt the use of helmets on the field, there appears to be momentum towards adopting rules and regulations regarding the use of helmets in competition. Therefore, the use of helmets seems like a natural, if not inevitable, component of the uniform for participation.

The initial proposals for women's helmets specify the use of a soft shelled and flexible helmet and eschews the use of the hard-shelled helmets used in sports such as American Football, or in men's lacrosse. The argument is that women's lacrosse remains a non-contact sport and checking or hitting of another player remains prohibited by rule. Therefore, without the need to use the heavy, bulky and rigid helmets from men's sports, the proposed helmets will be less bulky and prevent loss of the dexterity and speed. However, the governing bodies remain interested in providing a helmet that will provide protection in the form of a soft/flexible helmet and which provides for substantial protection to the eyes, face, and head of athletes.

Accordingly, because of incidental physical contact and also direct contact with a stick or ball, there is a need for sport specific head protection, eye protection, and protection of the face of female athletes. Therefore, there is a real and present need to improve safety for athletes in these sports, specifically by providing for sport appropriate head gear.

SUMMARY OF THE INVENTION

The embodiments herein provide for a new protective headgear having a protective and compressible outer layer, an inner non-compressible layer, an opening in the posterior/rear of the helmet to allow hair to exit the protective helmet, and juxtaposed to the posterior opening, a flap attached to the outer layer that covers a portion of the opening and is selectively attachable to the inner impact attenuating layer.

A soft helmet comprising an inner core and an outer shell, wherein the inner core comprises impact absorbing materials and a harness, wherein the outer shell comprises a posterior flap component having a flexible hingeable point on one end and provides for a selective attachment point to secure the portion obverse from the hingeable point, for protection of the rear of the head while providing for an opening for hair of the individual.

In a further embodiment, a soft helmet comprises an inner core and an outer shell, wherein the inner core comprises impact absorbing components and a harness and a posterior latch, and wherein the outer shell is made of a flexible, impact absorbing material and engages to and around the inner core, wherein a posterior flap is hingeably connected on one side of the outer shell and the obverse side of the flap comprises a corresponding snap to secure to the posterior latch on the inner core.

In a further embodiment, a protective headgear comprising: a protective impact absorbing outer layer; an inner impact attenuating layer; an opening in the posterior of the helmet to allow hair to exit the protective helmet; and wherein the posterior opening has a flap that covers a portion of the opening.

In a further embodiment, a protective headgear comprising: an elastomeric protective outer layer; an inner molded polymer shell; an inner impact attenuating layer; an opening in the posterior of the helmet to allow hair to exit the protective helmet; and wherein the posterior opening has a flap that covers with the outer elastomeric and inner molded polymer shell a portion of the opening.

A protective headgear comprising: a protective outer layer; an inner impact dispersing layer; a plurality of impact attenuating pads attached to the inner impact dispersing layer; a posterior opening in the outer protective later and in the inner impact dispersing layer; and wherein the posterior opening has a flap that covers a portion of the opening; wherein said flap has one side hingeably attached to the protective outer layer and an attachment means on the end of the flap to attach to the inner impact dispersing layer on the other side of the opening. In certain embodiments, the outer material is made from an elastomeric foam material, a molded polymer material, or a closed or open cell foam, each suitable to compress and return to its original shape. By comparison, the inner impact dispersing material is made from a semi-rigid material non-compressible material. The protective headgear comprises a rear flap that closes horizontally and can be opened and closed by the user while the headgear is donned.

A protective headgear comprising: a compressible protective outer layer having a front, two sides, a crown, a rear, a rear flap, a top and a bottom, said rear comprising a rear opening extending from the bottom to an intermediate position between the crown and the bottom; a non-compressible inner polymer shell having an outer face secured to the compressible protective outer layer, and an inner face having a front, sides and rear; an opening corresponding to the rear opening in the compressible protective outer layer; and comprising a left and right support positioned within said opening; at least one compressible pad attached to the inner polymer shell; the flap hingeably attached to one side of the rear of the compressible protective outer layer, having attached thereto, a flap core having a length sufficient to extend beyond the left and right supports of the inner core; and an attachment means suitable to connect said flap to an inner support of said inner core; and a rear securing strap having opposing ends connected to a portion of the inner support, and extending towards the rear and below the bottom of the helmet, and comprising a closure means to selectively tighten said rear strap.

In certain embodiments, the headgear comprises at least six compressible pads; wherein a first pad is positioned at the front of the inner core; a second pad is attached to the crown of the inner core; a third and fourth compressible pads attached to the left and right supports; and a fifth and sixth compressible pads attached to the sides of the inner core. In certain embodiments, at least one of the pads comprises a membrane having an opening therein and covering at least one type of compressible pad therein.

In a further embodiment, a helmet comprising: a compressible outer impact attenuating material having a rear flap; an inner non-compressible impact dispersing core, having a top a bottom, a crown, a rear, two sides, an inner surface, and, an outer surface that is in substantial contact with the compressible outer impact attenuating material; wherein a rear opening is provided in both the inner impact attenuating core and in the corresponding same space in the outer impact attenuating material, said opening extending from the bottom to a position between the crown and the bottom; means to secure the helmet under the chin of a user and around the occipital bone at the rear; wherein, disposed of on the interior surface of the inner impact dispersing core are compressible pads for attenuating forces; and the rear flap covering the opening at the rear of the helmet, the flap being hingeably attached to the outer impact attenuating material on one end, and having an attachment means at an opposing end of the rear flap to attach the rear flap to the inner core.

The embodiments preferably comprise a chin strap; wherein each end of the chin strap is secured to opposing sides of the inner core and comprising attachment means to secure the chin strap together.

The embodiments preferable comprise a rear securing strap having opposing ends connected to a portion of the inner support, and extending towards the rear and below the bottom of the helmet, and comprising a closure means to selectively tighten said rear strap.

DETAILED DESCRIPTION OF THE PREFERRED EMBODIMENTS

The embodiments of the invention described herein provide for a new soft helmet comprising an outer shell 1 and an inner core 20, wherein the inner core and outer shell comprise a rear flap 7 and latching mechanism at the back of the helmet. The need for the rear latching mechanism is twofold. First, there is no current helmet that provides for a mechanism to secure a pony-tail or otherwise hair in the rear of the helmet. This is often highly important for women, so as to secure hair so it is not in the way while participating. And second, a more pressing reason for the need to have a flap and latching mechanism is that the helmet must also pass certain safety tests, which include a pressure test positioned at the rear portion of the helmet.

Applicants designed several helmets and tested these against standard testing practices to confirm that the soft helmets would pass the necessary impact tests. However, a unibody construction that did not include the rear latching mechanism, failed the rear impact test (testing e.g. a ball hitting the helmet at high speed). By incorporating a two piece construction, an inner core, an outer shell, and incorporating a latching mechanism for a rear positioned flap, the helmet advantageously disperses impacts to the top, side, front, and rear of the helmet, to pass standards set in the industry for helmet protection.

Figure 1:
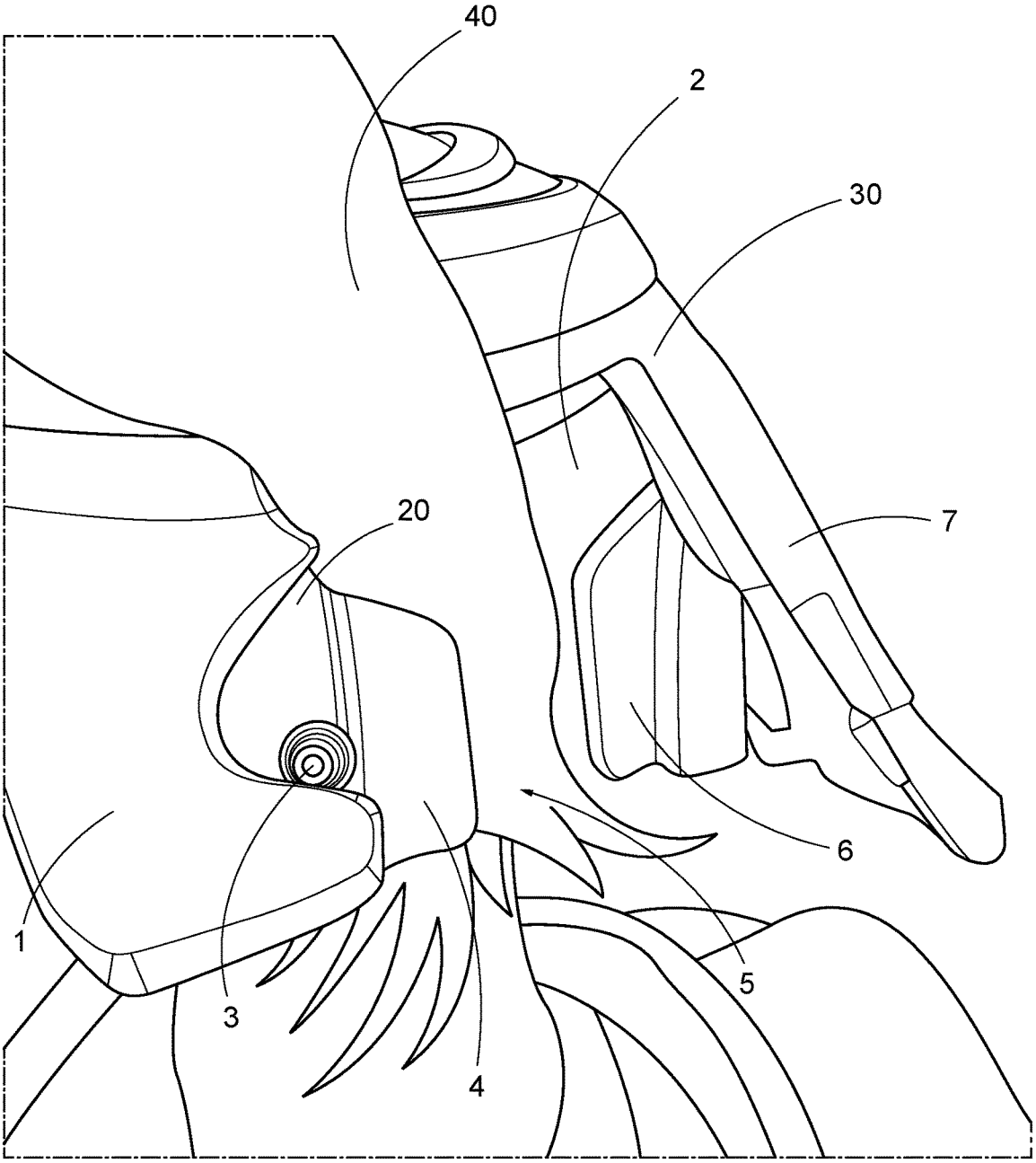
FIG. 1 depicts the rear portion of a soft helmet showing the outer shell and inner core.

FIG. 1 provides a depiction of a soft helmet having a protective outer shell (protective outer layer) 1, and an inner impact attenuating layer (or inner core) 20, wherein the inner core 20 in FIG. 1 depicts the left rear support 4 and the right rear support 6. The inner core 20 is an impact dispersing layer made of a stiff material that is not completely rigid, but is not as flexible or pliable as the material of the outer shell 1. The goal of the stiff material is to create support to allow for forces to be spread through the entirety of the helmet, thus dissipating the forces at the spot of impact. The material is properly made of a plastic or polymer material that provides for these features and also to support the outer shell 1. In certain embodiments, the inner core is a non-compressible material.

In comparison to the inner core 20, the outer shell 1 is a soft, compressible material having impact attenuating properties. The outer shell is appropriately made of an open cell or closed cell material, that can be compressed and return to substantially its original shape after impact. Certain low density open cell foams are appropriate, however, some closed cell foams, and those of a medium or high density may be appropriate in certain instances. In other embodiments, the outer shell 1 is an outer protective layer made of an elastomeric material. Indeed, the outer shell material is comprised of any of several compressible or flexible foam or foam like materials that provide impact attenuation and that return to their original shape after impact. The compression aids in the reduction of forces, as is known to a person of ordinary skill in the art. Force is directly reduced by the increase in time to impact, such that the more something compresses, the greater reduction in force is possible.

The outer shell and inner core are a generally domed shape with a crown, a rear, two sides, and a front. At the front, in certain embodiments, is a protruded lip or a visor like feature. However, the dome shape provides for a fit over the head of a user to expand the shells to the forehead of a user, adjacent to the ears, and at the rear, base, to just above the occipital bone.

The outer shell 1 fits tightly over the inner core 20 and when paired together, the helmet retains some flexibility. The flexibility is due, in part, to the inner shell opening 5, which allows for the left and right supports 4 and 6 so move and also to the material itself, having some ability to flex or give when the helmet itself is compressed. Therefore, the helmet can be compressed to some extent and is not rigid, in direct contrast to an American football style helmet that is both rigid and does not compress. In certain embodiments, the outer shell 1 and inner core 20 are glued together. In other embodiments, the two components may be adhered together by a glue or adhesive, hook and loop material, snap type connectors, and the like. Alternatively, the two components may be secured only by a tight fit and friction.

The outer shell 1 comprises a rear flap 7 having a hingeable portion 30 connected to the outer shell 1 and a snap 18 at the end of the rear flap that secures to a corresponding snap 3 positioned on the left rear support 4 of the inner core 20. The manner in which this is disposed, allows for the rear flap core 11 material disposed of in the interior surface of the rear flap 7 to extend beyond the inner shell opening 5 and over each of the left and right supports. This effectively provides for a portion of the inner core 20 material to cover the inner shell opening 5. Because of the inner core opening 5 and the rear opening 2 above the rear flap 7, an individual can pull hair through the openings and comfortably seat the helmet on her head.

The design of the inner core 20 provides for the inner core opening 5 to be positioned at the rear of the head, wherein the inner core opening 5 is poisoned to allow a sufficient opening at the base of the rear of the head so that a ponytail 40 can pass through the inner core opening 5. This opening extends from the base to about ½ way up the rear of the helmet towards the crown. Furthermore, the inner core opening 5 is designed to allow the rear left support 4 and the rear right support 6 to independently move. This, in turn, provides that the helmet can expand or be compressed slightly to improve the fit around the head of the individual user. Furthermore, forces applied to one side of the helmet, or to the rear of the helmet are dissipated through the moveable supports, the foam on the outer shell, the internal harness, and any additional internal shock absorbing materials. In particular, forces applied to the rear flap 7, i.e. a ball, stick, or person hitting that position, will allow the forces to dissipate through the outer shell and then through through the independently movable supports on the left and right, thus limiting the force applied at this point to the head of the person wearing the helmet.

Figure 2:
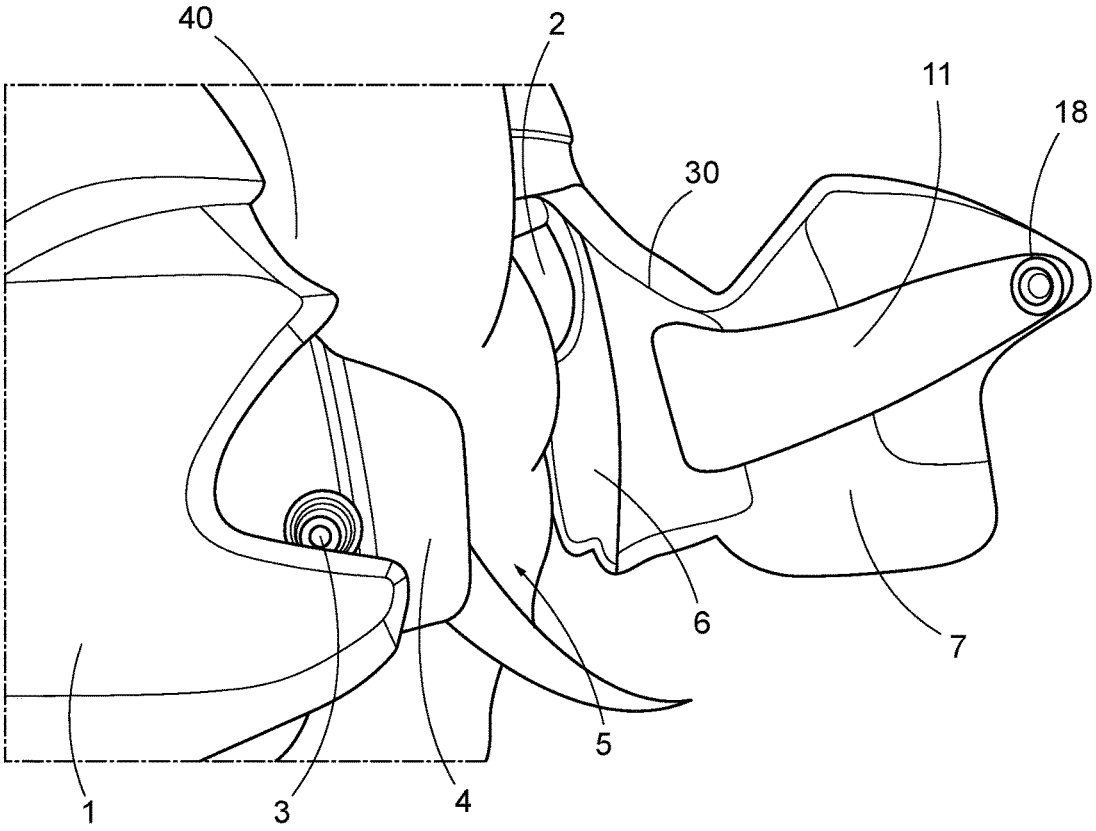
FIG. 2 depicts a detailed image of the rear latching component in an open position.

FIG. 2 provides a further detail of the rear flap 7, depicting that at the hingeable part 30, the rear flap 7 is not connected to the right rear support 6. The majority of the inner core 20 is in direct contact with the outer shell 1, such that the two components are selectively attached to one another, except for the rear flap 7. Indeed, this allows the rear flap 7 and the inner core 20 to independently move and allows for forces to move through the outer shell 1 and through each of the left and right sides of the inner core 20. Therefore the rear flap 7 can be independently fastened or unfastened while the helmet is worn by a user. This allows a user to adjust their hair in and through the rear opening 2 as necessary for fit.

Further depicted on the inner face of the rear flap 7 is a rear flap core 11. The rear flap core 11 is composed of the same or a similar material as the inner core 20 and is positioned to provide a rigid support to the rear flap 7. The snap 3, is visible on the left rear support 4, and will be utilized to selectively secure the rear flap 7, which has a corresponding snap feature 18 on the inner portion of the rear flap 7. By attaching the flap with attachment means, the rear flap core will cover the opening 5, and thus protects the rear of the head adjacent to the occipital bone.

Figure 3:
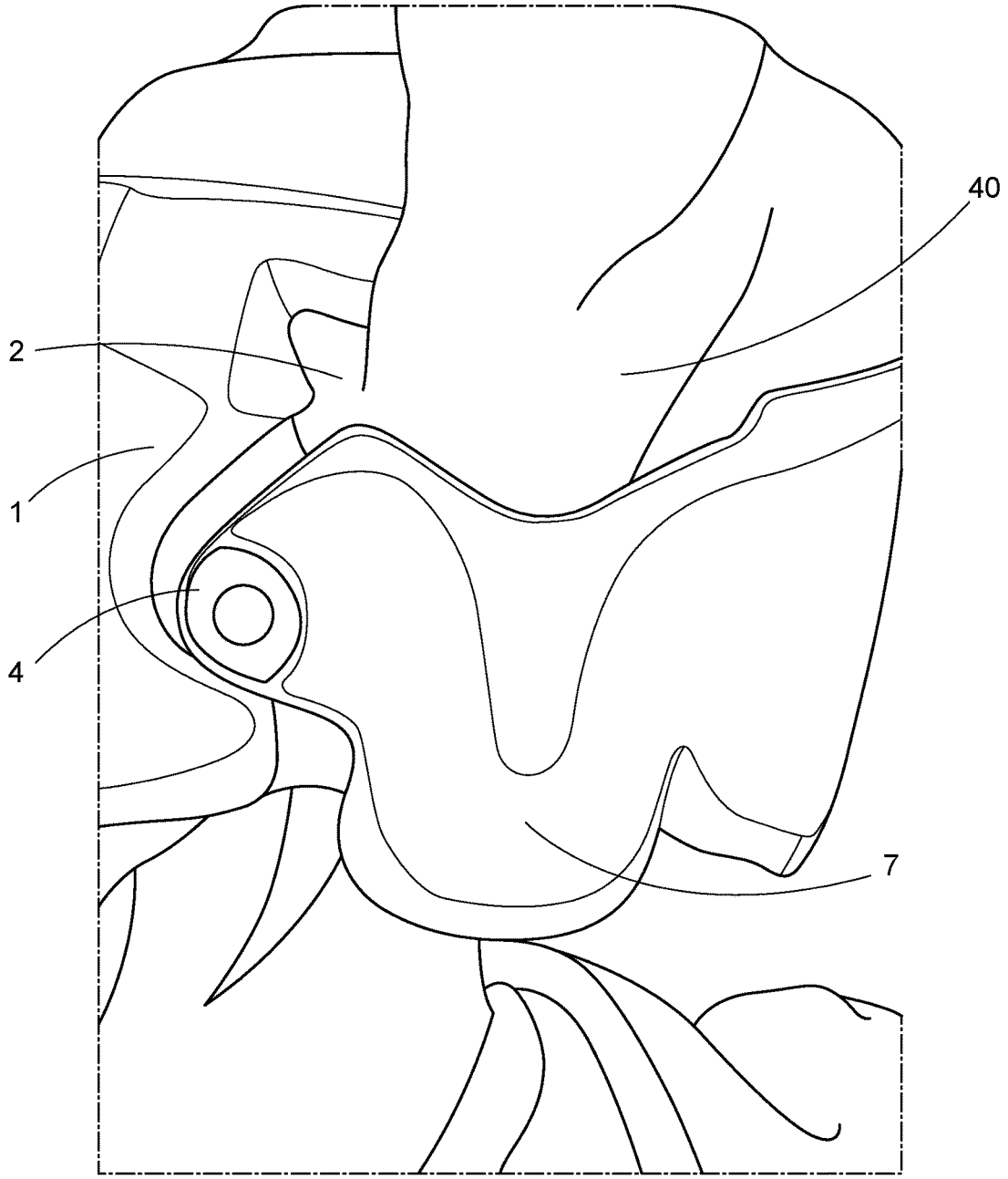
FIG. 3 depicts the rear of a soft helmet showing the rear latching component in a closed position.

FIG. 3 depicts the rear flap 7 having attachment means, here as depicted secured to the snap 3. By snapping the rear flap 7 to the rear left support 4 of the inner core 20, the outer shell 1 is secured around the player's head. The snap 3, in certain embodiments is attached to the inner core 20 on a slideable mechanism, such that the precise position of the snap 3 can be modified for appropriate fit. Conversely, the corresponding snap 18 can be moveable on the rear flap 7. In other embodiments, the snap can be positioned in one or more pre-drilled holes, so as to provide for a moveable fit. Accordingly, attachment means known to those of ordinary skill in the art can be utilized to secure the rear flap 7 to the left support 4 through snaps, peg and hole, buckle, hook and loop, string tie, and the like.

Figure 4:
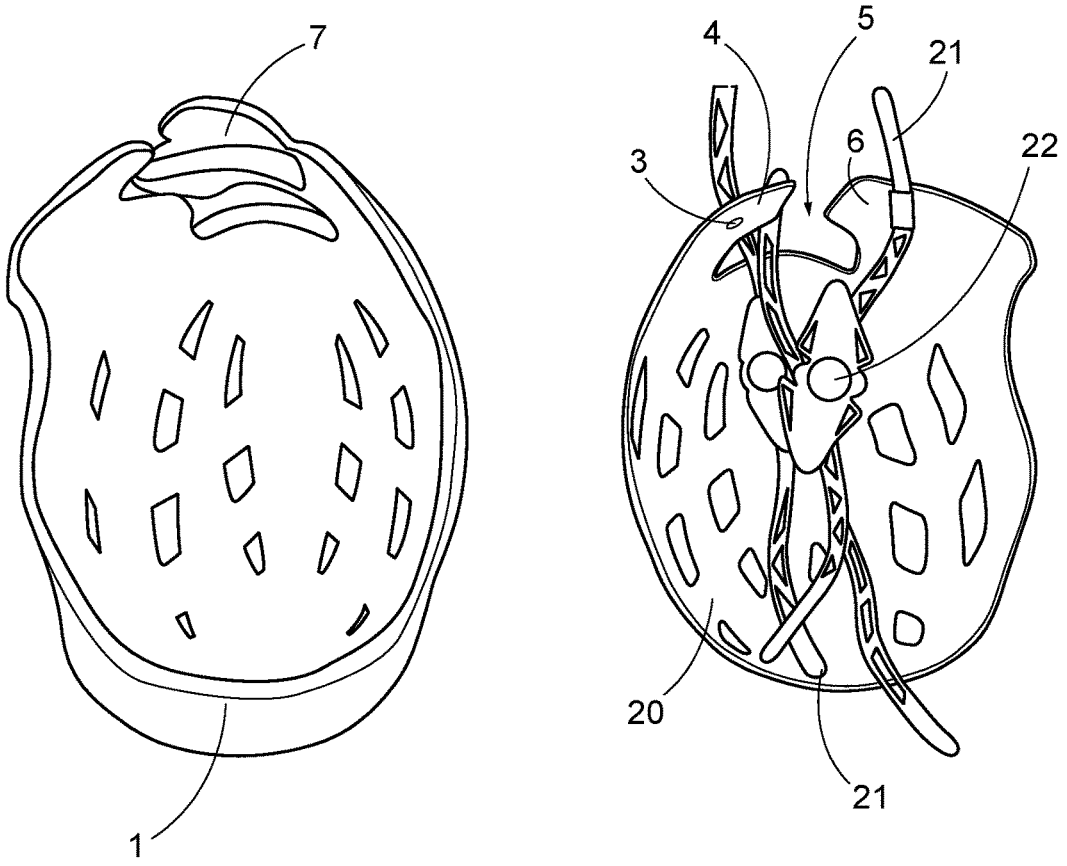
FIG. 4 depicts the outer shell on the left and the inner core on the right.

FIG. 4 depicts on the left, the outer foam shell 1, with the rear flap 7. On the right, is depicted the inner core 20, having the rear opening 5 between the left and right rear supports 4 and 6, with a snap 3 on the left rear support. The position of the snap can be exchanged to the left or the right support, so long as the outer shell and rear latch 7 correspond to pair with its position.

Also depicted in FIG. 4 are closure straps 21 and an occipital dial 22 for tightening and loosening the closure straps 21. The closure straps 21 are attached to the inner core 20 at opposite sides adjacent to the ear. The occipital dial 22 is positioned at the rear of the helmet and covered by a closure foam material 17 on the inside of the dial (see FIG. 7). In further embodiments, the occipital dial 22 may be advantageously positioned to the side of the helmet, so as position the dial within the outer shell or away from the neck. The closure foam material 17 is preferably an open cell, low density style foam to attenuate any hit to the occipital dial 17, but also for comfort in positioning and securing the helmet. This material may be the same as the foam for the forehead pad 9 and crown foam 10, as one example. The specific thickness can be modified by the user for comfort, increased compression, and sizing.

The occipital dial 22 allows the user to adjust the size of the helmet around the rear of the helmet. The occipital dial 22 comprises a rotatable disc that is connected to the closure straps on each side of the helmet, wherein rotating the disk will tighten or relax the fit. The rotatable disc can also utilize wire or string to tighten or relax the fit. In other embodiments, the mechanism to adjust the size of the helmed can be adjusted by other closure means, including, but not limited to snaps, hook and loop material, screw, rotation disk, or with adjustable straps and buckles as are known to one of ordinary skill in the art.

Figure 5:
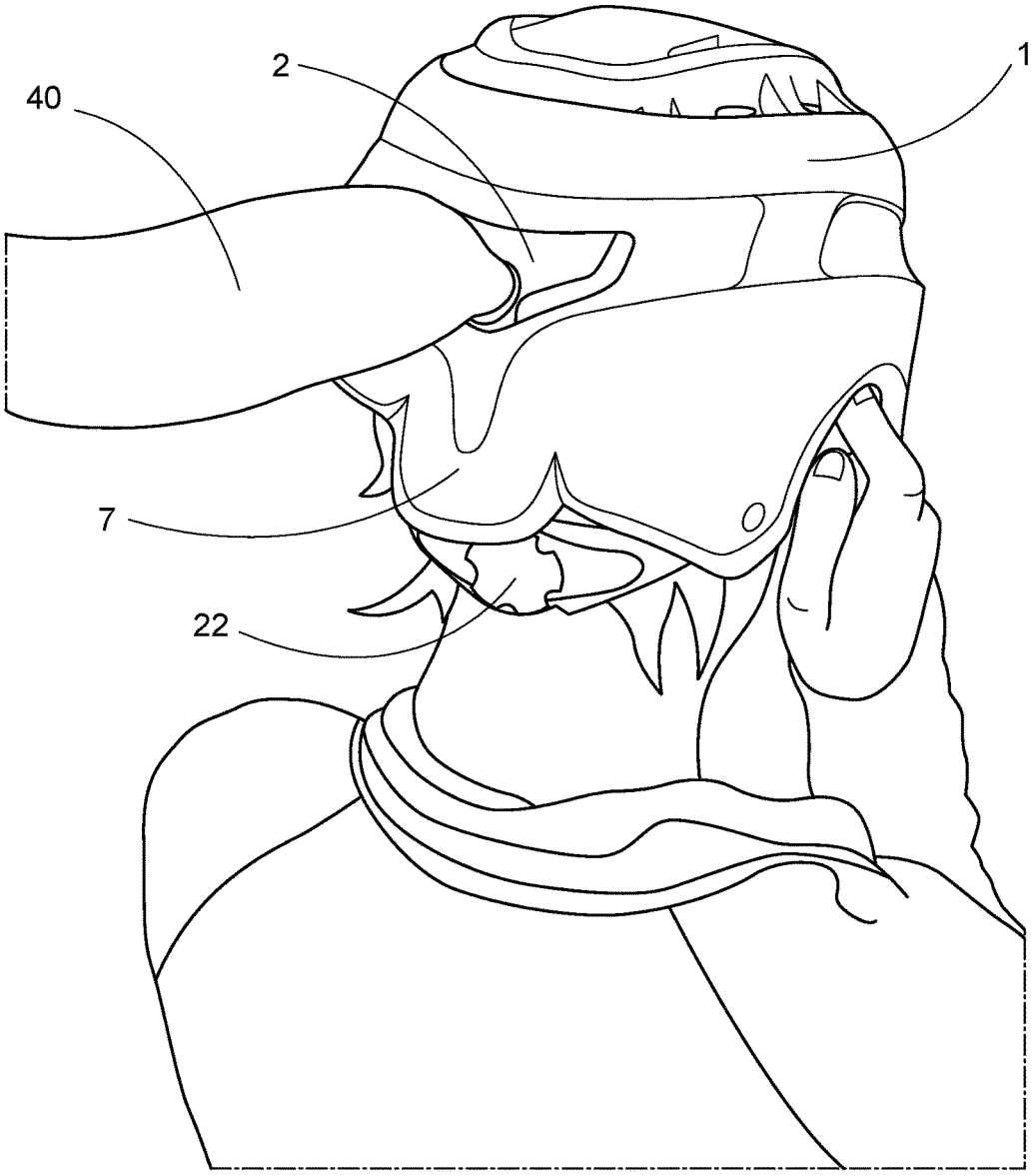
FIG. 5 depicts a rear view of a helmet as worn by an individual.
Figure 6:
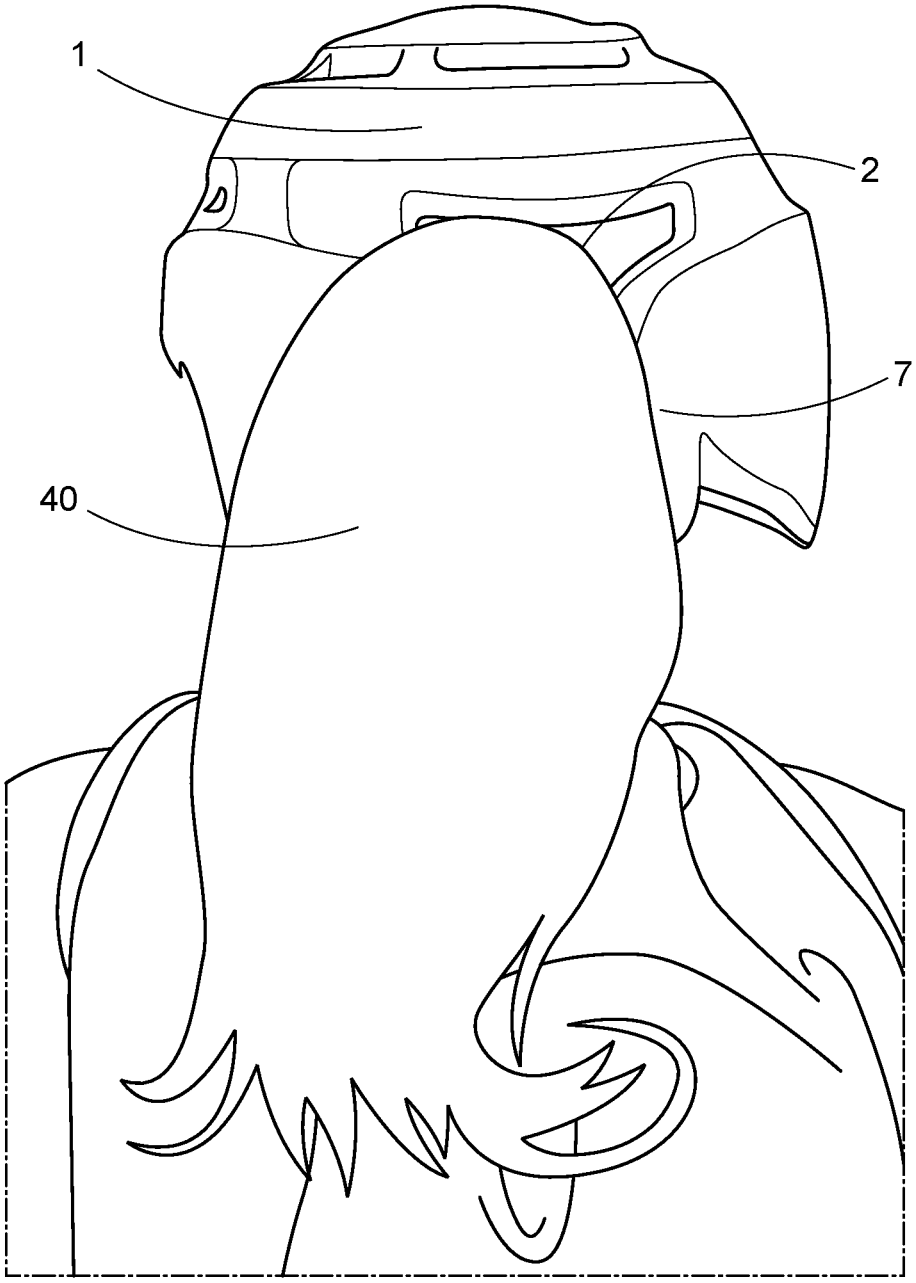
FIG. 6 depicts a rear view of a helmet as worn by an individual.

FIG. 5 further depicts the occipital dial 22 at the base of the helmet. Rotation of the occipital dial tightens the straps to create the proper fit of the harness to the head. The ponytail is shown clearly extending through the rear opening 2 hole with the flap 7 secured below the ponytail and securing the helmet to the users head. FIG. 6 provides a further image of hair extending out of the hole in the helmet and the flap 7 secured in position.

Figure 7:
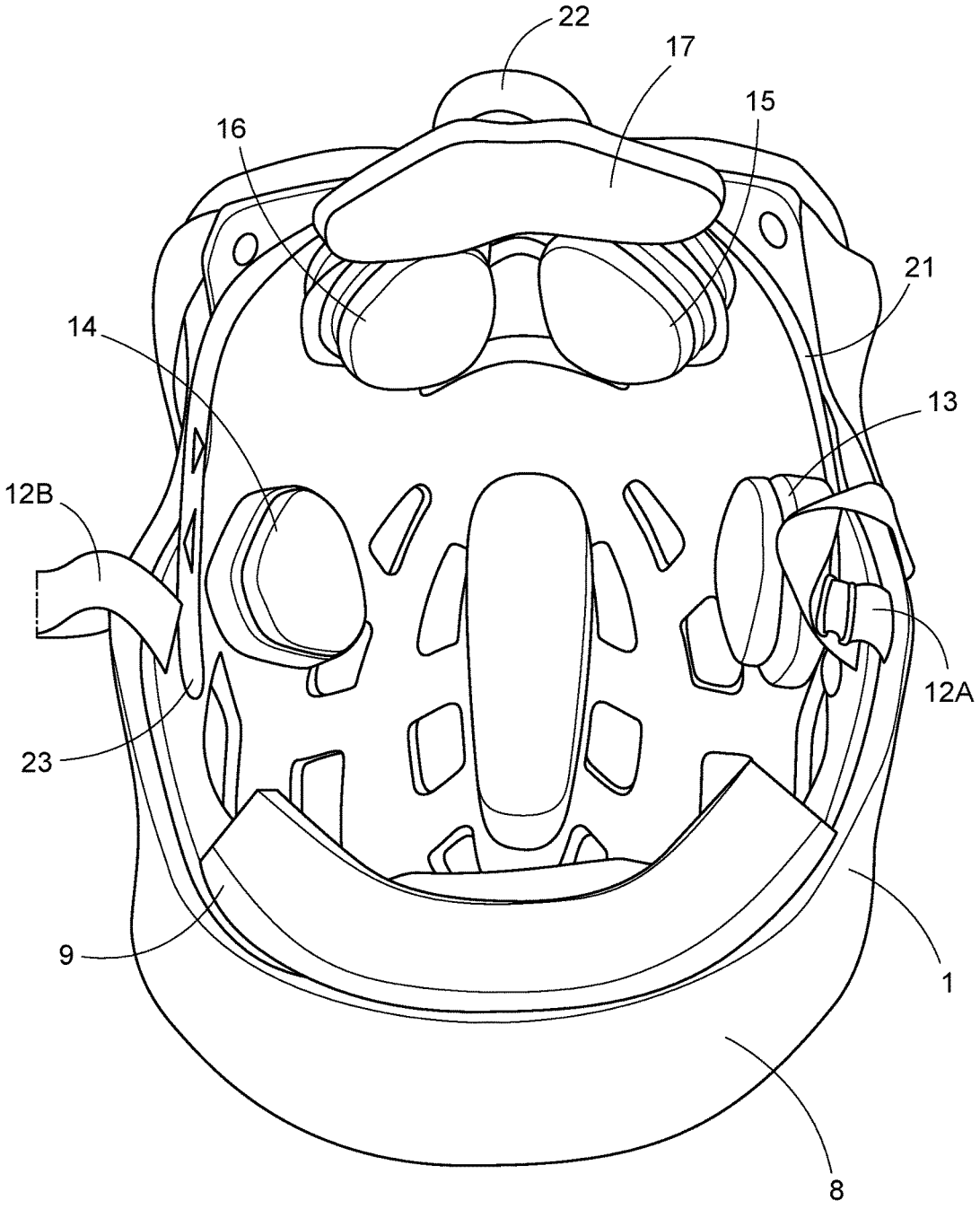
FIG. 7 depicts a view of the inside of a helmet.

FIG. 7 depicts a view of the inside of a helmet. The outer shell 1 is surrounding an inner core 20. At the far right of the image, the outer shell 1 comprises a hat or visor portion 8, which is a slightly protruding piece of the outer shell 1 foam. Directly inside of the hat portion 8, and attached to the inner shell 20 at, what would be the forehead section, is a forehead pad 9. This padding is preferably a compressible foam made of an ordinary low density open cell type foam, known to one of ordinary skill in the art. Positioned at the interior crown of the helmet is a crown foam 10. Positioned near the ears, and also at the rear left and right are four compression pads 13, 14, 15, and 16. These compression pads provide for an improved fit for the helmet as well as improving the abilities of the helmet to disperse forces. The precise thickness of the foam and the specific location can be determined by one of ordinary skill in the art. Additionally, the helmet may comprise more than the six listed pads, including extra pads in the crown, at the temple, or positioned along the internal sides of the helmet. Suitable compression pads include open and closed cell foams or polymer materials as known to a person of ordinary skill in the art.

Specific embodiments utilize compressible pads that comprise at least one type of compressible material surrounded by a membrane. The membrane has at least one hole to allow for air to enter and be compressed out of the membrane. For example, a particular brand of compression pad is a CRASH CLOUD™ pad, which comprises at least two types of foam material covered by a plastic membrane.

FIG. 7 also depicts a chin strap 12A and 12B, wherein a strap is connected to each side of the helmet at or adjacent to the ear, and then connects under the chin of a user with an ordinary securing mechanism. Appropriate modifications to loosen or tighten the straps provides for a secure fit under the chin of the user.

FIG. 7 further defines a pair of rear closure straps 21. The rear closure straps 21 are connected to the inner core 20, for example adjacent to the ear 23. The rear closure straps 21 serve to secure the helmet to the head of the user, by incorporating a strap that sits at the rear of the head adjacent to the occipital bone. By placing the helmet on a user's head, the user can adjust the fit of the helmet by loosening or tightening these closure straps 21. In a preferred embodiment, an occipital dial 22 is utilized and positioned at the rear of the helmet, and the occipital dial 22 can be rotated to tighten or loosen the closure straps 21. In combination with the closure straps 21 around the rear of the helmet, by adjusting the occipital dial 22 and providing the appropriate level of closure foam material 17, the helmet is properly secured to a user's head. The closure foam material 17 further assists in protecting the rear of the head from contact.

Additional closure mechanisms may include a ring fit, variations of exchangeable pads having different thicknesses, for a pad fit, cam locks or various straps, snaps, hook and loop material, and the like. Many of these closure and securing mechanisms are in use or have been used in the bicycle helmet industry. The closure mechanism, whichever is utilized, assists in securing the closure straps 21 to create a snug fit around the rear of the head of the user.

Figure 8:
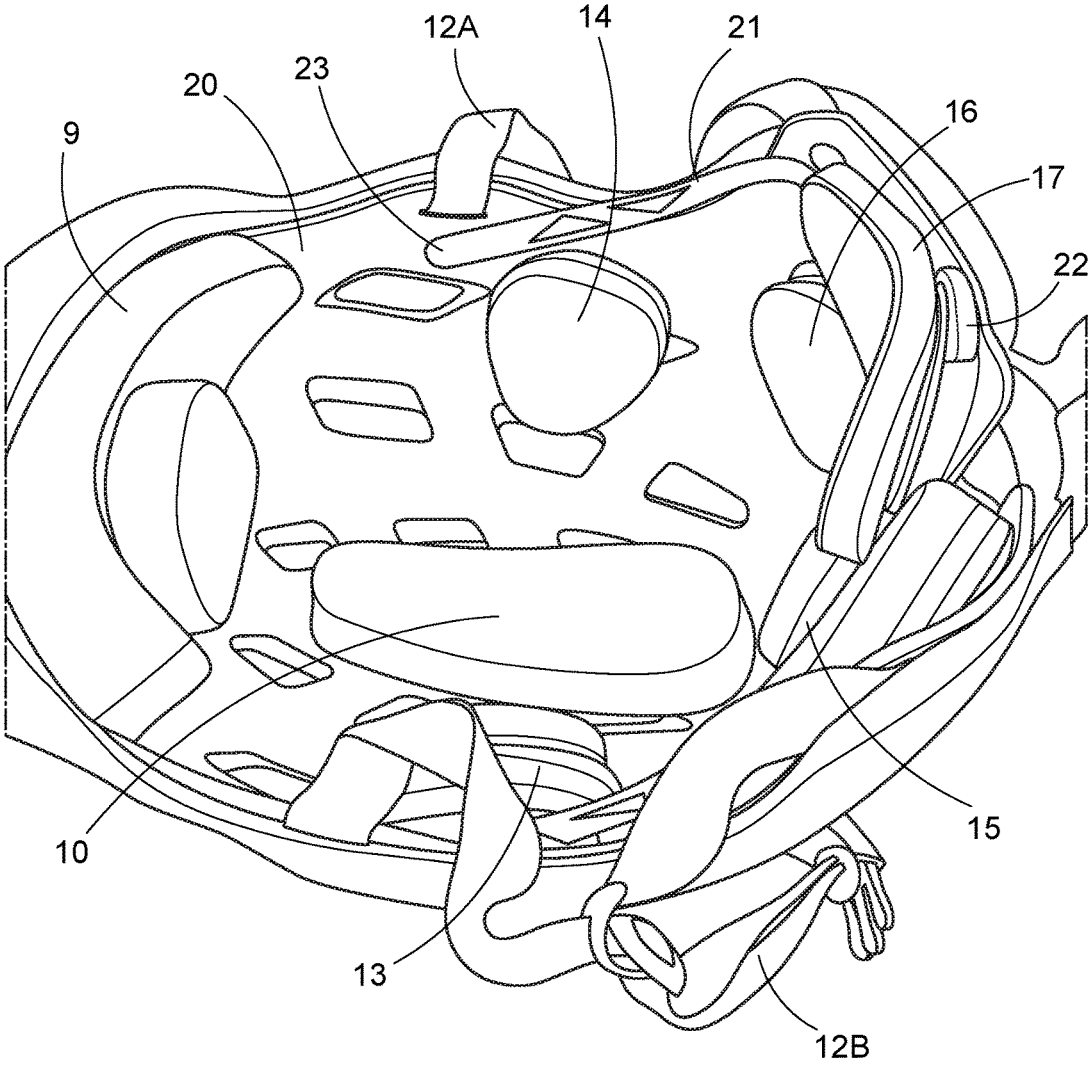
FIG. 8 depicts a further view of the inside of a helmet.

FIG. 8 depicts a bottom side profile of the helmet, again depicting the features from FIG. 7.

Figure 9:
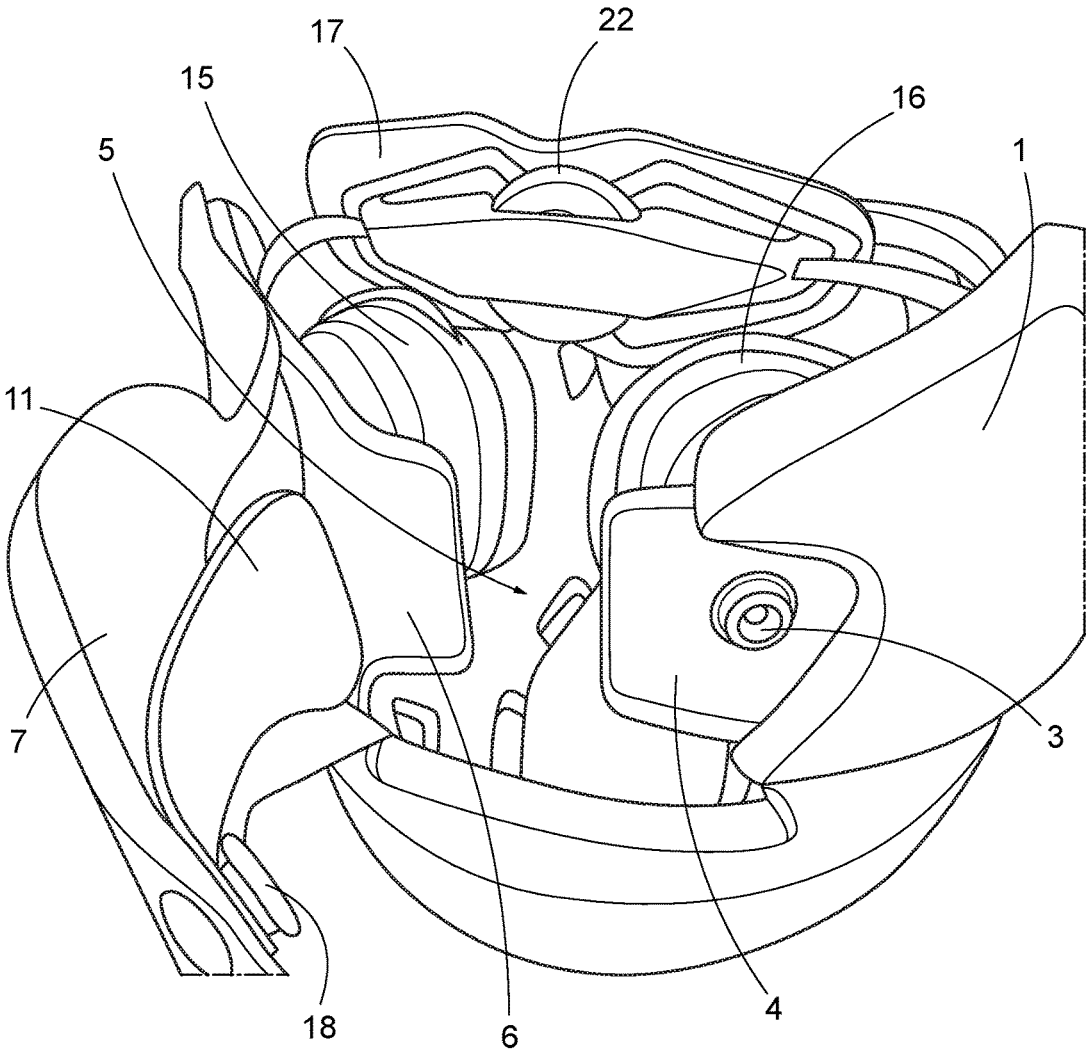
FIG. 9 depicts a further view of the inside of a helmet.

FIG. 9 depicts a rear profile of the helmet. In particular, the rear flap 7 is pulled away from the helmet and a rear flap core 11 is depicted attached to the rear flap. Also depicted on the inner portion of the rear flap 7 is the corresponding snap feature 18 to pair with the snap 3 on the inner core 20. The occipital dial 22 and the closure foam material 17 are also clearly depicted.

The ability of the flap 7 to be affixed to the inner core 20 provides a secure connection, provides for an adjustable opening for the player based on head size, provides an opening for the hair of the user, and provides an important feature for disseminating forces applied to the rear portion of the helmet. Indeed, contact with the rear portion of the helmet will first hit the soft outer shell 1, which will compress, due to the structure of the foam. The rear flap core 11 will then protect the shell opening 5 and forces will disseminate to the inner core 20 and to the left and right rear supports 4 and 6. This will then allow the inner shell 20 to slightly compress, as the left rear support 4 and the right rear support 6 can flex to slightly narrow this shell opening 5. Furthermore, these features can move independently thus allowing forces to be dispersed throughout the helmet and not concentrated on a single point. This aids in disseminating the forces applied to the rear of the helmet and assists in preventing injury should a direct force be applied to that portion of the helmet. Ultimately, the forces are applied to the compression pads 15, 16, 13, 14, as well as 9, 10, and 17. The force compresses these pads, and the compression reduces the forces ultimately applied to the head. Together, the components of the helmet work together to reduce the forces as applied to a point on the helmet.

In addition to the safety profile of the rear flap 7, a further benefit of the rear flap 7 is the ease of which the player can undo the rear flap 7 and pull the player's hair through the shell opening 5 and the rear opening 2. This provides for the easiest way to allow a user to comfortably orient their hair and also to securely and comfortably position the helmet to the user's head. In other helmets, there is no ability to open a latch, and so hair must be pulled through an opening. This can often lead to uncomfortable pulling of the hair, or worse, lead to unsafe positioning of the helmet. The use of a sport specific helmet, having an opening designed for safety and fit, and with the particular female user, or male user with long hair in mind, improves the ability of the helmet to securely fit and to maintain the proper fit throughout use. Proper fit and orientation of hair thus leads to a more secure and safe helmet.

Furthermore, there are no other soft helmets that utilize a rigid inner core that comprises a rear opening 5, followed by a compressible exterior foam shell that is positioned over and around the inner core, and that comprises a flap system that latches to one side of the inner core. Such system provides for an improved fit, greater comfort for the user, and provides for a safe and effective manner to secure the helmet for the user.

Accordingly, in preferred embodiments, the helmet comprises a compressible outer impact attenuating material, an inner impact dispersing core that is stiff; wherein an opening is provided in the rear portion of both the inner impact dispersing core and in the corresponding same space in the outer impact attenuating material. Furthermore, provided is a first means to secure the helmet under the chin of a user and a second means to secure the helmet around the occipital bone. Disposed of on the interior surface of the inner impact dispersing core are compressible pads for attenuating forces. Finally, covering the opening at the rear of the helmet is a rear flap, hingeably attached to the outer impact attenuating material, and having an attachment means at the end of the rear flap to attach the rear flap to the inner core.

A preferred embodiment of the helmet comprises an outer core, an inner core, a plurality of compression pads, a rear securing strap, a chin strap, and a rear flap; the outer core being a compressible material and attached to an outer face of the inner core; the inner core is a semi-right material; the compression pads are positioned on an inner face of the inner core and positioned at least at the front, sides, top, and rear of the inner face of the inner core; the chin strap comprises at least a length of material connected to the inner or outer core on each side of the helmet, and comprising an attachment means to be secured together; the rear securing strap comprising a first and second length of material; each connected on opposing inner faces of the inner core; and comprising an adjustable mechanism capable of adjusting the length of the rear securing strap; and the rear flap comprises an outer flap core and an inner flap core and is positioned over an opening at the rear of the outer core and inner core.

A helmet having an outer core, an inner core, a plurality of compression pads, a chin strap, a rear securing strap, and a rear flap; the outer core having an inner and outer face and having a domed shape with a plurality of openings in the dome and a rear flap hingeably attached to one side of the outer core; the inner core having an inner and outer face with the outer face being secured to the inner face of the outer core; and attached to the inner face of the inner core are a plurality of compression pads; a chin strap, having an attachment point on each side of the inner core; and a rear securing strap, having an attachment point on each side of the inner core; attachment means for connecting the chin strap and second attachment means for connecting the rear securing strap; and the rear flap comprising an attachment means to secure to said inner core and a rear flap core positioned on the inner face of the rear flap.

What is claimed is:

1. A protective headgear comprising:

a compressible protective outer layer having a front, two sides, a crown, a rear, a rear flap, a top and a bottom, said rear comprising a rear opening extending from the bottom to an intermediate position between the crown and the bottom;

a non-compressible inner polymer shell having an outer face secured to the compressible protective outer layer, and an inner face having a front, sides and rear; an opening corresponding to the rear opening in the compressible protective outer layer; and comprising an inner left and right support positioned within said opening;

at least one compressible pad attached to the inner polymer shell;

the flap hingeably attached to one side of the rear of the compressible protective outer layer, having attached thereto, a flap core having a length sufficient to extend beyond the left and right supports of the inner polymer shell; and an attachment means suitable to connect said flap to an inner support of said inner polymer shell; and a rear closure strap having opposing ends connected to a portion of the inner support, and extending towards the rear and below the bottom of the headgear, and comprising a closure means to selectively tighten said rear strap.

2. The protective headgear of claim 1 further comprising a chin strap.

3. The protective headgear of claim 1 wherein the outer layer is made from an elastomeric foam material.

4. The protective headgear of claim 1 wherein the outer layer is made from a molded polymer material.

5. The protective headgear of claim 1 wherein the inner polymer shell is made from a semi-rigid material.

6. The protective headgear of claim 1 comprising at least six compressible pads; wherein a first pad is positioned at the front of the inner polymer shell; a second pad is attached to the crown of the inner polymer shell; a third and fourth compressible pads attached to the left and right supports; and a fifth and sixth compressible pads attached to the the inner polymer shell sides.

7. The protective headgear of claim 6 wherein at least one of the compressible pads comprises a membrane having an opening therein and covering at least one type of compressible pad therein.

* * * * *